US005264868A

United States Patent [19]

Hadley et al.

[11] Patent Number: 5,264,868

[45] Date of Patent: Nov. 23, 1993

[54] NON IMPACT PRINTER APPARATUS WITH IMPROVED CURRENT MIRROR DRIVER

[75] Inventors: Mary A. Hadley; Jeffrey A. Small, both of Rochester, N.Y.

[73] Assignee: Eastman Kodak Company, Rochester, N.Y.

[21] Appl. No.: 825,459

[22] Filed: Jan. 23, 1992

Related U.S. Application Data

[63] Continuation of Ser. No. 543,892, Jun. 26, 1990, abandoned.

[51] Int. Cl.[5] ..... B41J 2/435; B41J 2/45

[52] U.S. Cl. ..... 346/107 R; 346/154

[58] Field of Search ..... 395/108, 109

[56] References Cited

U.S. PATENT DOCUMENTS

| | | | |
|---|---|---|---|
| 4,370,666 | 1/1983 | Noda et al. . | |
| 4,583,037 | 4/1986 | Sooch | 323/315 |
| 4,746,941 | 5/1988 | Pham et al. | 346/154 X |
| 4,831,395 | 5/1989 | Pham et al. | 346/160 |
| 4,885,597 | 12/1989 | Tschang et al. | 364/519 |
| 4,952,949 | 8/1990 | Uebbing | 346/154 |
| 5,015,942 | 5/1991 | Kolenko | 323/315 |

OTHER PUBLICATIONS

Grey, Paul R. and Meyer, Robert G., *Analysis and Design of Integrated Circuits*, John Wiley & Sons, pp. 733-735.

Patent Abstracts of Jap., vol. 4, No. 139 (M-34) (621) 30 Sep. 1980 (JP A, 55 095 584, Minowa 19 Jul. 1980.

Patent Abstracts of Jap., vol. 13, No. 299, (M-847) (3647) 11 Jul. 1989 (JP A, 1090 744 (Hirane) 7 Apr. 1989.

*Primary Examiner*—Benjamin R. Fuller
*Assistant Examiner*—David Yockey
*Attorney, Agent, or Firm*—Norman Rushefsky

[57] ABSTRACT

In a non-impact printer apparatus such as an LED printhead a current mirror driver is used to control current to the recording elements, e.g., LED's. The current mirror driver is incorporated in an integrated circuit driver chip and a plurality of these chips are provided on the printhead. Each chip includes two sets of digitally addressable transistors. This allows for individual chip control of current to the respective LED's to correct for nonuniformity of light output from chip to chip due to temperature gradients as well as controlling for light output due to aging of the printhead. A continuously conducting transistor is associated with each set of addressable transistors to provide a minimum offset bias current level and selective activation of the addressable transistors provides for selective increase of a bias current over the minimum level. The bias current is mirrored in those LED's selected for activation.

7 Claims, 5 Drawing Sheets

NON IMPACT PRINTER APPARATUS WITH IMPROVED CURRENT MIRROR DRIVER

This is a continuation of application Ser. No. 07/543,892, filed Jun. 26, 1990 now abandoned.

CROSS REFERENCE TO RELATED APPLICATIONS

This application is related to the following applications filed on even date herewith:

1. U.S. application Ser. No. 07/543,931, filed in the names of Yee S. Ng et al and entitled, "Non-Impact Printer for Recording in Color;"
2. U.S. application Ser. No. 07/543,891, filed in the name of Jeffrey Small and entitled, "L.E.D. Printer Apparatus with Improved Temperature Compensation;"
3. U.S. application Ser. No. 07/543,930, filed in the names of Jeffrey A. Small et al and entitled, "Non-Impact Printer with Token Bit Control of Data and Current Regulation Signals;"
4. U.S. application Ser. No. 07/543,929, filed in the names of Martin Potucek et al and entitled, "L.E.D. Array Printer with Extra Driver Channel."
5. U.S. application Ser. No. 07/543,507, filed in the names of Mike Mattern et al and entitled, "L.E.D. Printhead with Improved Current Mirror Driver and Driver Chip Therefor."

BACKGROUND OF THE INVENTION

1. Field of the Invention

The present invention relates to non-impact printing apparatus for recording on a moving photoreceptor or the like and a printhead for use therewith. The invention also relates to an improved driver chip for use with such non-impact printing apparatus.

2. Brief Description of the Prior Art

In the prior art as exemplified by U.S. Pat. No. 4,885,597, printer apparatus is described which comprises a multiplicity of individually addressable and energizable point-like radiation sources, such as LED's, arranged in a row for exposing points upon a photoreceptor during movement thereof relative to and in a direction normal to the row. Driver circuits are provided for simultaneously energizing the radiation sources responsive to respective data bit input signals applied to the driver circuits during an information line period. The print or recording head includes a support upon which are mounted chips placed end to end and upon each of which are located a group of LED's. The driver circuits are formed as integrated circuits and are incorporated in chips that are located to each side of the linear array of LED chips. The driver circuits in this apparatus each include a shift register for serially reading-in data-bit signals and for driving respective LED's in accordance with the data signals.

Associated with each driver chip is a current-level controller that controls the level of current into the LED's of that group during recording. The controller comprises a current mirror having a master control circuit whose current is mirrored in slave circuits to which the LED's are connected. One advantage of this prior art printer apparatus is that current to the LED's may be changed automatically as needed, due to changes in aging or temperature of the printhead. As such changes affect the light output of the LED's, the changes to the current compensate for same so that some uniformity is provided to the recording apparatus.

In the current mirror described in this prior art, there are provided two avenues for adjustability. Firstly, there is a "system bias" voltage which is adjustable to compensate for loss in intensity of light output from the LED's due to aging, i.e., hours of use. Since aging will affect most LED's on a printhead to about the same extent, the loss in intensity due to aging may be overcome by changing the system bias voltage which causes additional current to be provided to the LED's. This change in system bias voltage may be characterized as a "global" change since the change in system bias voltage affects all driver chips on the printhead. In order to change system bias voltage, a new digital word is sent to a digital current mirror control that is separate from the driver chips. By enabling the appropriate current-carrying transistors, a new level of system bias may be provided to each driver chip. Incorporated within each driver chip is an additional current mirror that is also subject to digital regulation and can be used to provide "local" regulation or control for such localized effects as temperature and other chip to chip nonuniformities.

While the above approach can work well, there are occasions where due to processing conditions used in manufacturing the circuit providing system bias voltage and at least some of the driver chips that a change in system bias voltage affects different driver chips on the same printhead to different extents. Also, the long lead lines for distributing system bias voltage to each of the driver chips subjects this voltage to noise, thereby further affecting the driver chips differently.

A further problem with the approach of the prior art is that calibration can be difficult in that where for the same system bias level, the current to each LED may be varied from zero to some large value depending upon the digital word sent to each driver chip controlling the localized part of the current control. In order to accommodate this broad range of possible current levels, fine control can only be obtained by increasing the number of possible levels. However, this adds more complexity to the printhead in that it requires more data bits to provide digital regulation of current. The other alternative of settling for coarse control of allowable changes to current level results in compromise to uniformity control.

It is an object of the invention to improve upon the printer apparatus of the prior art to overcome the above noted problems.

SUMMARY OF THE INVENTION

An improved non-impact printer apparatus is described which comprises a plurality of groups of recording elements, a plurality of integrated circuit driver chips for driving respective groups of recording elements, each driver chip including: first digitally addressable current-conducting means for selectively establishing a first bias voltage in response to a first multibit signal; second digitally addressable current-conducting means responsive to the first bias voltage and to a second multibit digital signal for generating a bias current; means responsive to said bias current for establishing a second bias voltage; means for selectively causing current to flow through recording elements selected for energization; and current mirror driver means for regulating current through said selected recording elements, the level of current being related to said second bias voltage.

In accordance with another aspect of the invention, a non-impact printer apparatus used for recording is described that includes: a plurality of groups of recording elements, a plurality of integrated circuit driver chips for driving respective groups of recording elements; each driver chip including digitally addressable current-conducting means for selectively establishing a bias voltage in response to a digital addressing; means responsive to said bias voltage for generating a bias current; means for selectively causing current to flow through recording elements selected for energization; current mirror driver means for regulating current through said selected recording elements, the level of current being related to said bias current, and a non-digitally addressable continuously operating current conducting means cooperating with said digitally addressable current-conducting means to establish an offset bias voltage level for said bias voltage.

In accordance with still another aspects of the invention, there are provided driver chips having the inventive features set forth above.

DESCRIPTION OF THE PREFERRED APPARATUS

The apparatus of the preferred embodiments will be described in accordance with an electrophotographic recording medium employing LED's as an exposure source. The invention, however, is not limited to apparatus for creating images on such a medium or with such exposure devices as other media such as photographic film, etc. may also be used with the invention as well as other devices for providing image creation in accordance with the teachings of the invention.

DETAILED DESCRIPTION OF THE PREFERRED EMBODIMENTS

Because electrophotographic reproduction apparatus are well known, the present description will be directed in particular to elements forming part of or cooperating more directly with the present invention. Apparatus not specifically shown or described herein are selectable from those known in the prior art.

Figure 1:
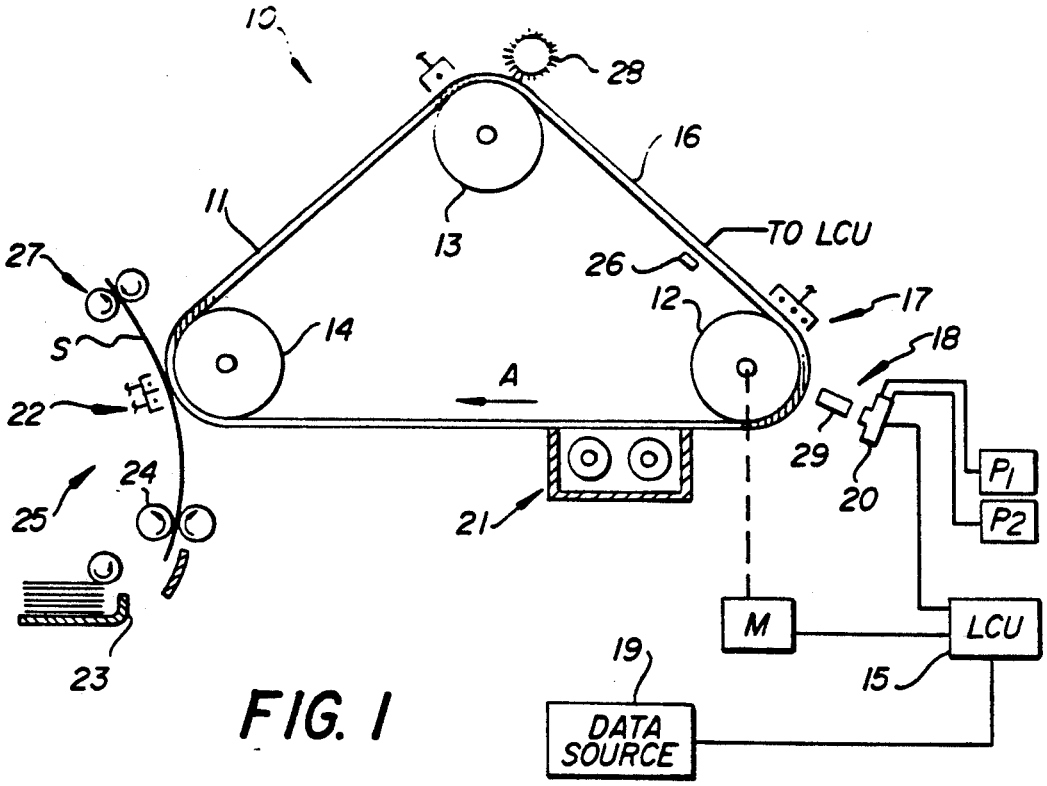
FIG. 1 is a schematic of a print apparatus made in accordance with the invention.

With reference now to FIG. 1, an electrophotographic reproduction apparatus 10 includes a recording medium such as a photoconductive web 11 or other radiation-sensitive medium that is trained about three transport rollers 12, 13 and 14, thereby forming an endless or continuous web. Roller 12 is coupled to a drive motor M in a conventional manner. Motor M is connected to a source of potential when a switch (not shown) is closed by a logic and control unit (LCU) 15. When the switch is closed, the roller 12 is driven by the motor M and moves the web 11 in a clockwise direction as indicated by arrow A. This movement causes successive image area of the web 11 to sequentially pass a series of electrophotographic work stations of the reproduction apparatus. These stations will be briefly described.

First, a charging station 17 is provided at which the photoconductive surface 16 of the web 11 is sensitized by applying to such surface a uniform electrostatic primary charge of a predetermined voltage. The output of the charger may be controlled by a grid connected to a programmable power supply (not shown). The supply is in turn controlled by the LCU 15 to adjust the voltage level Vo applied onto the surface 16 by the charger 17.

At an exposure station 18 an electrostatic image is formed by modulating the primary charge on an image area of the surface 16 with selective energization of point-like radiation sources in accordance with signals provided by a data source 19. The point-like radiation sources are supported in a printhead 20 to be described in more detail below.

A development station 21 includes developer which may consist of iron carrier particles and electroscopic toner particles with an electrostatic charge opposite to that of the latent electrostatic image. Developer is brushed over the photoconductive surface 16 of the web 11 and toner particles adhere to the latent electrostatic image to form a visible toner particle, transferable image. The development station may be of the magnetic brush type with one or two rollers. Alternatively, the toner particles may have a charge of the same polarity as that of the latent electrostatic image and develop the image in accordance with known reversal development techniques.

The apparatus 10 also includes a transfer station 25 shown with a corona charger 22 at which the toner image on web 11 is transferred to a copy sheet S; and a cleaning station 28, at which the photoconductive surface 16 of the web 11 is cleaned of any residual toner particles remaining after the toner images have been transferred. After the transfer of the unfixed toner images to a copy sheet S, such sheet is transported to a heated pressure roller fuser 27 where the image is fixed to the copy sheet S.

As shown in FIG. 1, a copy sheet S is fed from a supply 23 to driver rollers 24, which then urge the sheet to move forward onto the web 11 in alignment with a toner image at the transfer station 25.

To coordinate operation of the various work stations 17, 18, 21, and 25 with movement of the image areas on the web 11 past these stations, the web has a plurality of indicia such as perforations along one of its edges. These perforations generally are spaced equidistantly along the edge of the web 11. At a fixed location along the path of web movement, there is provided suitable means 26 for sensing web perforations. This sensing produces input signals into the LCU 15 which has a digital computer, preferably a microprocessor. The microprocessor has a stored program responsive to the input signals for sequentially actuating, then de-actuating the work stations as well as for controlling the operation of many other machine functions. Additional encoding means may be provided as known in the art for providing more precise timing signals for control of the various functions of the apparatus 10.

Programming of a number of commercially available microprocessors is a conventional skill well understood in the art. This disclosure is written to enable a programmer having ordinary skill in the art to produce an appropriate control program for the one or more microprocessors used in this apparatus. The particular details of any such program would, of course, depend on the architecture of the designated microprocessor.

Figure 2:
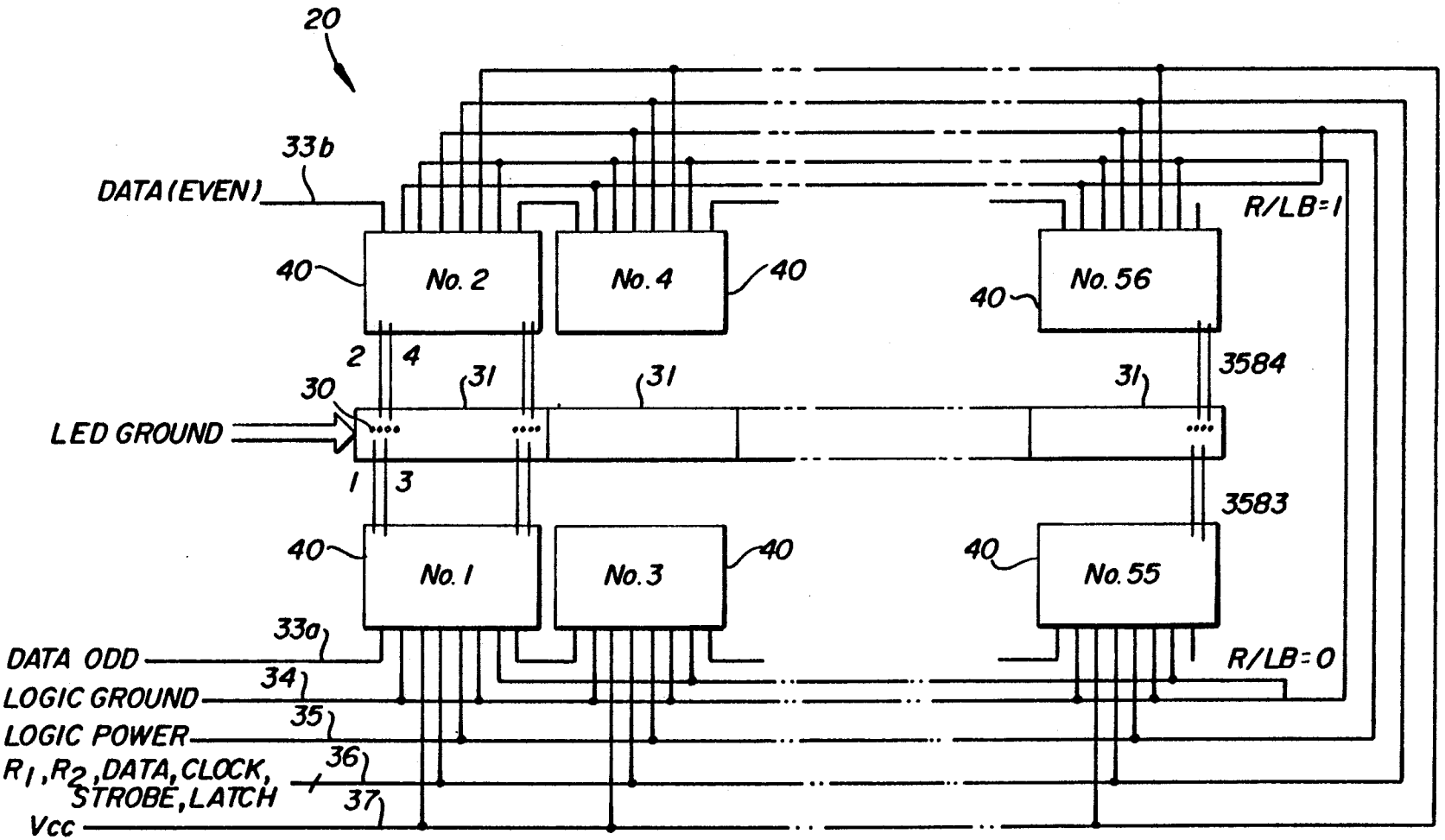
FIG. 2 is a block diagram of circuitry used in forming the printhead shown in FIG. 1 in accordance with the invention.

With reference to FIGS. 1 and 2 and to U.S. Pat. No. 4,885,597 and to U.S. Pat. No. 4,746,941, the contents of both of which are incorporated herein by this reference, the printhead 20, as noted, is provided with a multiplicity of energizable point-like radiation sources 30, preferably light-emitting diodes (LED's). Optical means 29 may be provided for focusing light from each of the LED's onto the photoconductive surface. The optical means preferably comprises an array of optical fibers such as sold under the name Selfoc, a trademark for a gradient index lens array sold by Nippon Sheet Glass, Limited. Due to the focusing power of the optical means 29, a row of emitters will be imaged on a respective transverse line on the recording medium.

With reference to FIG. 2, the printhead 20 comprises a suitable support with a series of LED chips 31 mounted thereon. Each of the chips 31 includes in this example 128 LED's arranged in a single row. Chips 31 are also arranged end-to-end in a row and where twenty-eight LED chips are so arranged, the printhead will extend across the width of the web 11 and include 3584 LED's arranged in a single row. To each side of this row of LED's there are provided twenty-eight identical driver chips 40. Each of these driver chips include circuitry for addressing the logic associated with each of 64 LED's to control whether or not each of the LED should be energized as well as to determine the level of current to each of the LED's controlled by that driver chip 40. Two driver chips 40 are thus associated with each chip of 128 LED's. Each of the two driver chips will be coupled for driving of alternate LED's. Thus, one driver chip will drive the odd numbered LED's of the 128 LED's and the other will drive the even numbered LED's of these 128 LED's. The driver chips 40 are electrically connected in parallel to a plurality of lines 34–37 providing various electrical control signals. These lines provide electrical energy for operating the various logic devices and current drivers in accordance with their voltage requirements. A series of lines 36 (indicated by a single line in this FIG.) provide clock signals and other pulses for controlling the movement of data to the LED's in accordance with known techniques. Data lines **33*a* and 33*b*** are also provided for providing data signals in the form of either a high or low logic level. The driver chips each include a data in and data out port so that they serially pass data between them.

Figure 3:
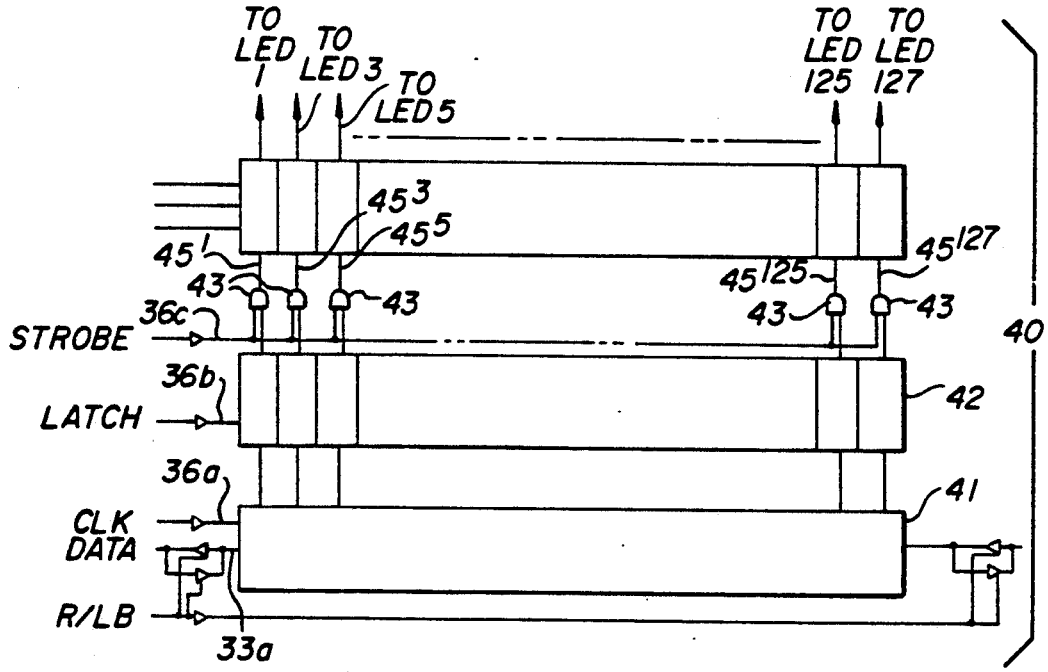
FIG. 3 is a block diagram of a driver circuit with data-handling logic for use in the printhead of FIG. 2.

With reference now to FIG. 3, the architecture for each driver chip 40 includes a 64-bit bidirectional shift register 41. A logic signal carried over line R/LB determines the direction data will flow down this register. Assume that this chip is enabled to cause data to flow down the register from left to right as shown in FIG. 3. Data thus enters shift register 41 over line **33*a* through the driver chip's data-in port at the left from say the data-out port of a driver chip immediately to the left or from the LCU if the driver chip 40 is the first chip for data to enter. Data exits from this chip at the data-out port to be input to the next adjacent driver chip to the right of driver chip 40. For each line of image to be exposed in the main scanning direction, i.e., transverse to that of movement of the recording medium or web 11, data from the data source suitably rasterized, in accordance with known techniques, streams serially through the shift registers under control of clock pulses provided by the LCU over line 36*a*. As may be noted, odd and even data may be moved simultaneously since they are provided on separate lines 33*a*, 33*b*. Still further reductions in clock speed for moving data through the shift registers may be provided by providing additional lines for distributing data simultaneously. When 3584 bits of data (1's or 0's) are stored by the shift registers of all of the driver chips, a latch signal is provided over line 36*b* to latch this data into latch registers 42 so that the shift registers 41 may commence filling with data signals for the next line of exposure. Sixty-four latch registers 42 are provided in each driver chip to receive the data shifted out in parallel fashion from the shift register 41. Each latch register is associated with a particular LED and adjacent latch registers are associated with every other LED. A logic AND gate 43 is associated with each latch register and has one input coupled to the output of its respective latch register and its other input coupled to a line 36*c*** for providing a strobe or timing pulse from the LCU. This strobe pulse determines when to trigger the LED's to turn on in relation to the position of the recording medium and the duration for which the LED's are turned on. All the AND gates have one of their inputs connected to this strobe line. Alternatively, a plurality of strobe lines may be provided with enabling times of different durations; see in this regard U.S. Pat. No. 4,750,010 to Ayers et al, the contents of which are incorporated herein by this reference. The output of each of the AND gates is coupled to a logic circuit that is part of a constant current driver circuit. In a further alternative as noted in aforementioned U.S. Pat. No. 4,746,941, the printhead may be of the so-called grey level type wherein multiple data bits per pixel are used to establish the pulsewidth duration of an LED.

Figure 4A:
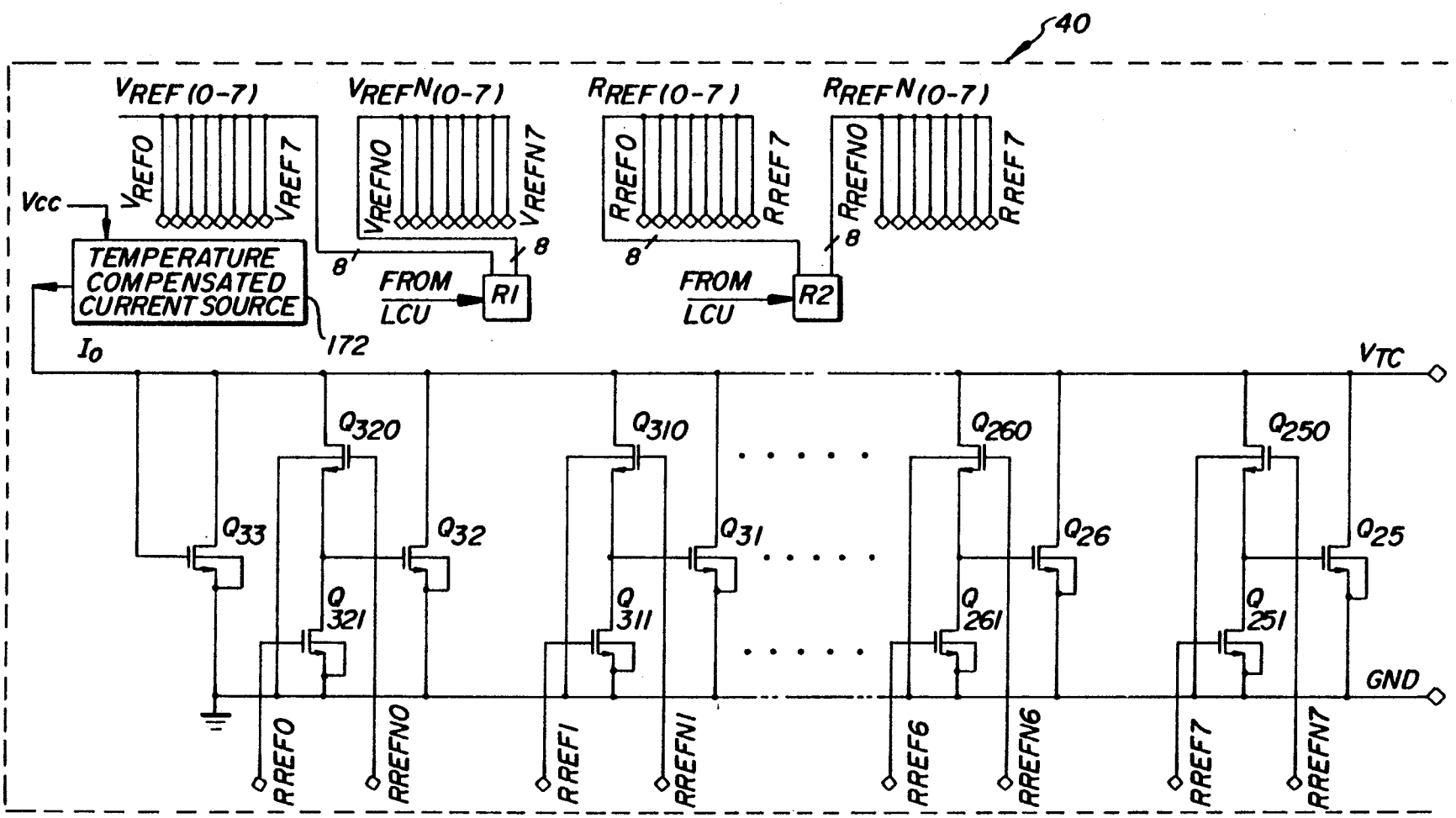
FIGS. 4A, B and C comprise a schematic of a current driving circuit for the driver circuit of FIG. 3.
Figure 4B:
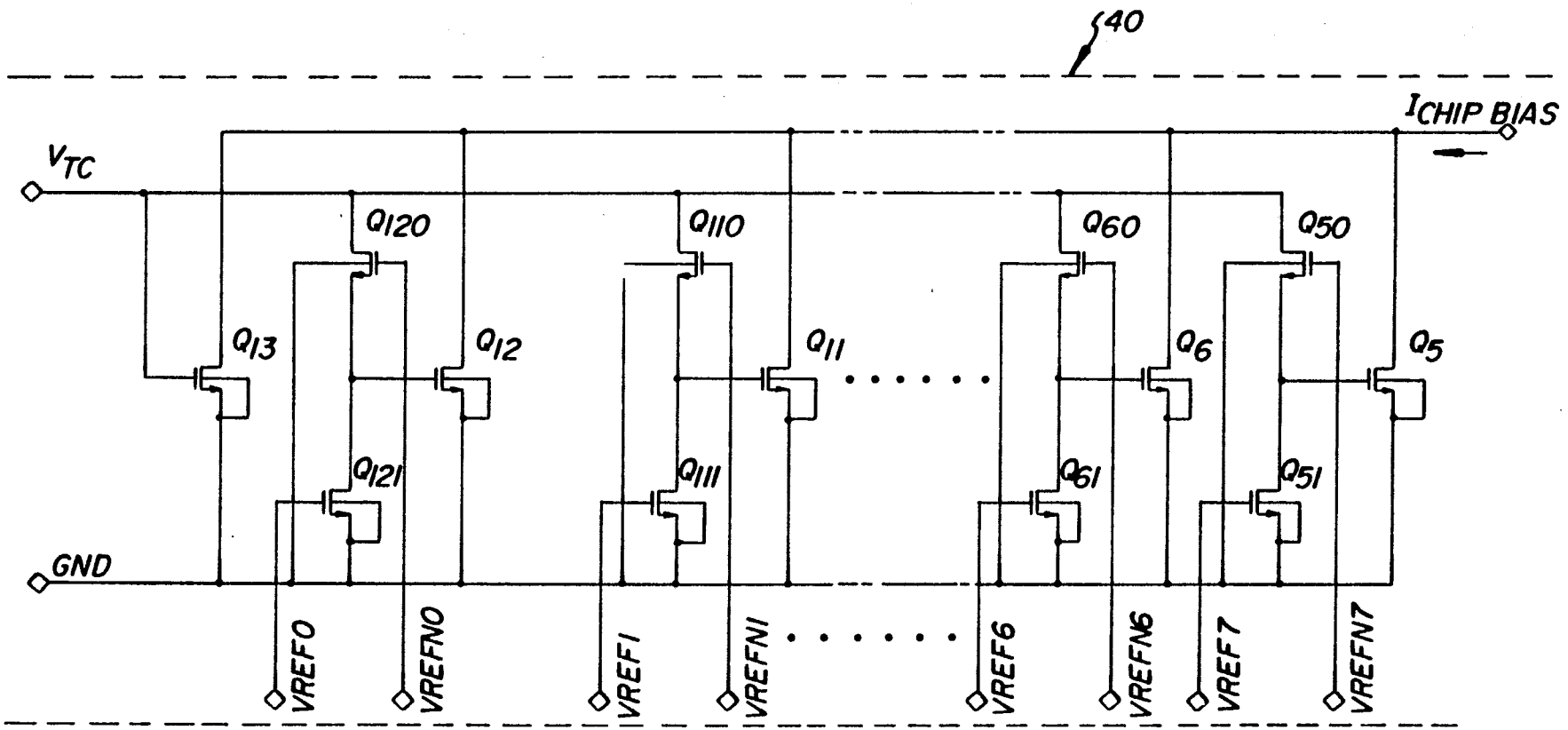
Figure 4C:
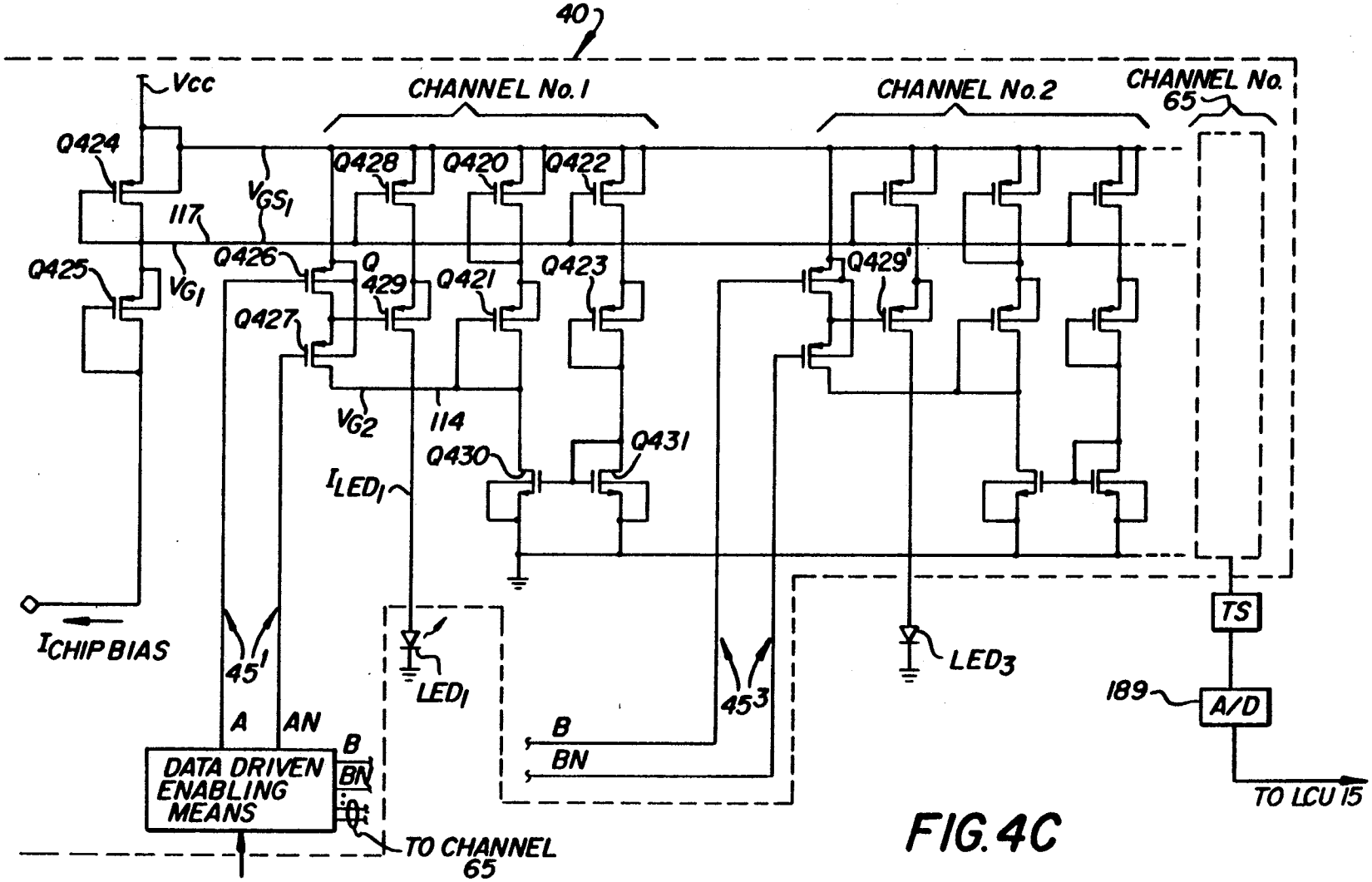

With reference now to FIG. 4C, the output of each AND gate is fed over respective lines $45^1$, $45^3$, and the following lines not shown $45^5$, --- $45^{125}$, $45^{127}$. As may be seen each of these lines is actually a double line one of which carries an enable signal to turn the respective LED on and the other carries a complement of this signal. The lines $45^1$ (A and its logic inverse AN) are input to respective control electrodes of transistors $Q_{426}$, $Q_{427}$. These transistors act as switches and form a part of a current mirror driving circuit that includes a master circuit formed by transistors $Q_{424}$, $Q_{425}$ and a series of digitally controlled transistors. More details concerning the digitally controlled transistors will be found below with reference to the discussion of FIGS. 4A and 4B. Briefly, these digitally controlled transistors may be selectively turned on to establish a signal I (CHIP BIAS) to thereby regulate a desired current level for the LED's driven by this driver chip. As may be noted in FIG. 4C, circuitry for driving two LED's, i.e., $LED_1$ and $LED_3$ are illustrated; it being understood that the driver chip would have appropriate circuits typified by those described below for driving say 64 of the odd-numbered LED's in an LED chip array having, for example, 128 LED's. Another driver chip on the other side of the LED chip array would be used to drive the 64 even-numbered LED's.

The current through the master circuit establishes a potential $V_{G1}$ on line 117. Directly in series with $LED_1$ are two transistors $Q_{428}$, $Q_{429}$. Transistor $Q_{428}$ is biased to be always conductive while transistor $Q_{429}$ is switched on and off and thus is the transistor controlling whether or not current is driven to $LED_1$. The gate or control electrode of transistor $Q_{429}$ is coupled to the drain-source connection of transistors $Q_{426}$, $Q_{427}$. When $LED_1$ is to be turned on, transistor $Q_{427}$ is made conductive and when $LED_1$ is to be turned off, transistor $Q_{426}$ is made conductive. The gate of transistor $Q_{426}$ receives a logic signal that is the inverse of that to gate $Q_{427}$ from a data driven enabling means of FIG. 3 which controls whether or not an LED is to be turned on and for how long. As noted above in a grey level printhead, the LED is to be turned on for a duration determined by the grey level data signals input to the printhead. In this regard, see aforementioned U.S. Pat. No. 4,750,010 and U.S. application Ser. No. 07/290,002.

Also associated with the circuitry for driving $LED_1$, is an additional current mirror that includes two slave circuits. One slave circuit comprises transistors $Q_{420}$, $Q_{421}$ and $Q_{430}$. The other slave circuit comprises transistors $Q_{422}$, $Q_{423}$ and $Q_{431}$. Transistors $Q_{430}$, $Q_{431}$ are N-channel MOSFETS while the other transistors noted above are P-channel MOSFETS. The two additional slave circuits associated with $LED_1$ are on continuously and assuming a nominal driving current of say $I_{LED1}=4$ ma to $LED_1$, the current through transistor $Q_{421}$ might be 1/80 $I_{LED1}$ and the current through transistor $Q_{423}$ might be $1/800\times I_{LED1}$. The currents through these slave circuits establishes a voltage level $V_{G2}$ on line 114, which is the potential of the drain electrode of transistor $Q_{427}$.

In operation with transistor $Q_{429}$ turned off, transistor $Q_{426}$ is on and impresses approximately the voltage $V_{cc}$ at the gate of transistor $Q_{429}$. When $LED_1$ is to be turned on to record a pixel (picture element), a signal is provided by the data enabling means to the gate of transistor $Q_{427}$ to turn same on, while an inverse signal turns transistor $Q_{426}$ off. Before transistor $Q_{429}$ turns on, the capacitive load existing between its gate and substrate must be removed. When transistor $Q_{427}$ turns on the charge on the gate terminal of transistor $Q_{429}$ discharges through transistors $Q_{427}$ and $Q_{430}$. This path for discharge of the gate capacitive load at transistor $Q_{429}$ thereby provides a turn-on time not affected by the number of LED's that are sought to be simultaneously energized. The reason for this is that each control transistor corresponding to transistor $Q_{429}$ has its own respective path for discharge of its respective capacitive load. While the illustrated embodiment shows use of the additional current mirror circuit containing transistor $Q_{430}$ for use in discharging the control electrode of the driving transistor, it will be understood that in some circuit arrangements, charging, rather than discharging, of the control electrode may be facilitated.

Current through transistors $Q_{422}$, $Q_{423}$ and $Q_{431}$ is proportional to, i.e. mirrors, that through the master circuit because of the identical gate to source terminal biasing ($V_{GSI}$) of transistors $Q_{424}$ and $Q_{422}$. Thus, current is constant in this slave circuit even though $V_{cc}$ from power supply $P_2$ varies since the potential difference $V_{GSI}$ between the gate and source terminal of transistor $Q_{422}$ remains constant. The current through the slave circuit comprised of transistors $Q_{422}$, $Q_{423}$ and $Q_{431}$ is mirrored by that through the slave circuit comprised of transistors $Q_{420}$, $Q_{421}$ and $Q_{430}$ due to the identical gate to source biasing of transistors $Q_{430}$, $Q_{431}$. With a constant current being generated in the slave circuit comprised of transistors $Q_{420}$, $Q_{421}$ and $Q_{430}$, the potential difference between the gate and source terminals of transistor $Q_{420}$ remains fixed as does that of transistor $Q_{421}$ thereby establishing a voltage level $V_{G2}$ on line 114 which varies with $V_{cc}$ although the potential difference $V_{cc}-V_{G2}$ remains constant.

With the transistor $Q_{429}$ turned on and conducting driving current to $LED_1$ during an exposure period, the voltage level $V_{G2}$ is established at the gate of transistor $Q_{429}$ via now conducting transistor $Q_{427}$. The voltage level at the source terminal of transistor $Q_{429}$ is now at a fixed threshold value above that of $V_{G2}$. Transistor $Q_{429}$, acting as a cascode transistor and having its source terminal connected to the drain terminal of transistor $Q_{428}$, thereby establishes the drain potential of the transistor $Q_{428}$ as varying with changes in $V_{cc}$. As noted above, the potential difference $V_{GS1}$ is constant even though $V_{cc}$ itself varies. The voltage relationships between the various terminals of transistor $Q_{428}$ are not affected by variations in $V_{cc}$ and the current to $LED_1$ during a period for recording a pixel stays constant.

Thus, stability in driver current to $LED_1$ is provided since transient changes in $V_{cc}$ do not cause corresponding changes to the current conducted through $LED_1$ and thus do not affect the intensity level of light output by $LED_1$. The tendency in some LED printheads for light output of an LED to diminish when other LED's are turned on can also be reduced with this circuit. As noted above, transistor $Q_{429}$ conducts current to $LED_1$ for a time period controlled by the strobe signal or in the case of a grey level printer, for a period controlled by the data bits for recording an appropriate pixel. The level of current for recording this pixel is controlled by the current mirror which is responsive to the current level I(CHIP BIAS). The circuit for generating I(CHIP BIAS) forms a part of the invention and will now be described.

When transistor $Q_{429}$ is turned on, the current passing there through mirrors, i.e., is either the same or proportional to, the current passing through transistor $Q_{425}$. The current passing through transistor $Q_{425}$, in turn, is equal to I (CHIP BIAS). With reference now to FIGS. 4A and 4B, this current, I(CHIP BIAS) in turn is controlled by three factors comprising a temperature-compensated current source 172, a first group of eight digitally controlled NMOSFET transistors $Q_{25}$, $Q_{26}$ . . . , $Q_{31}$, $Q_{32}$ and a second group of eight digitally controlled NMOSFET transistors $Q_5$, $Q_6$. . . , $Q_{11}$, $Q_{12}$. Associated with the first group is a non-digitally controlled NMOSFET transistor $Q_{33}$. Similarly associated with the second group is non-digitally controlled NMOSFET transistor $Q_{13}$. As may be noted in FIGS. 4A and 4B, not all of the transistors are shown and the number of digitally controlled transistors provided in each group determines the level of control. Transistors $Q_{25}$, . . . , $Q_{32}$ are parallel connected transistors whose respective gate width to gate length ratios are scaled so that their respective currents are scaled or weighted in powers of two. For example, where eight digitally controlled transistors are provided for this first group ($Q_{25}$–$Q_{32}$), respective gate width to gate length ratios may be $$\frac{256}{2}:\frac{128}{5}:\frac{64}{5}:\frac{32}{5}:\frac{16}{5}:\frac{8}{5}:\frac{4}{5}:\frac{2}{5}\text{ and }\frac{321.5}{5}$$

for non-digitally controlled transistor $Q_{33}$.

Each digitally controlled transistor is controlled by a logic signal applied to a respective two-transistor switch circuit associated with the transistor. For example, the circuit defined by NMOSFET transistors $Q_{250}$ and $Q_{251}$ cause current to flow through transistors $Q_{25}$ when a high level logic signal is applied to the gate of transistor $Q_{250}$ and a complementary low logic signal is applied to the gate of transistor $Q_{251}$. The logic signals for controlling which of the current-carrying transistors are to be turned on are controlled by a register $R_2$ which stores an 8-bit digital word and its 8-bit complement representing a desired current control signal to turn on respective ones of the eight current conducting transistors $Q_{25}, \ldots Q_{32}$. In conjunction with transistor $Q_{33}$, which is on continuously, this group of transistors is used for "localized" control of LED current. By this, it is meant that the digital word stored in register $R_2$ is specific for this driver chip and will be determined by adjustment of driver current to the LED's driven by this driver chip until the LED's each provide a desired light output level. This digital word may be input to the register R2 from memory in the LCU or from a separate memory such as a ROM provided on the printhead. This digital word may also be changed in response to the temperature of the driver chip, as say, measured by a suitable temperature sensor TS. See, for example, U.S. Pat. No. 4,831,395 regarding an LED printhead employing correction temperature compensation using adjustment of $V_{REF}$. See also above noted U.S. Pat. No. 4,885,597. In cross-referenced U.S. application #4 there is provided a description of an LED printhead employing current mirrors to control current to the LED's in which the level of current from an extra current mirror channel (#65) on each driver chip is used as a measure of temperature. The detected current is compared by the LCU with a value representing current which should flow to the LED's based on the digital words in register R1 and R2. The temperature sensed by the sensor TS is communicated to the LCU 15 using an analog-to-digital converter 189 and in response thereto, the LCU "writes" a new digital word into register R2, if a change in current level is required according to an algorithm stored in memory. The sensor TS may generate a voltage in response to the current in the extra channel.

As noted in aforementioned U.S. Pat. No. 4,831,395, the contents of which are incorporated by this reference, the LCU may be programmed to maintain a count of prior activations of each LED and adjust a control voltage according to a program based on the aging characteristics of the printhead.

After this initial calibration and as the printhead ages through repeated use, both temperature and age factors operate to degrade light output. The affects due to aging, as noted above, will generally be similar to all LED's and are corrected for by adjustment of an 8-bit digital word and its 8-bit complement stored in register $R_1$.

This digital word controls 8 current-carrying NMOSFET transistors $Q_5, \ldots, Q_{12}$. Associated with this group of transistors is a continuously conducting NMOSFET transistor $Q_{13}$. Exemplary gate width to length ratios for weighted digitally controlled transistors $Q_5$–$Q_{12}$ are $$\frac{896}{5} : \frac{448}{5} : \frac{224}{5} : \frac{112}{5} : \frac{56}{5} : \frac{28}{5} : \frac{14}{5} : \frac{7}{5} \text{ and } \frac{4027}{5}$$

for non-digitally controlled transistor $Q_{13}$. The 8-bit word and its 8-bit complement stored in register $R_1$ is the same as that stored in identical registers $R_1$ on the other driver chips. As the printhead ages, a new 8-bit digital word and its 8-bit complement is calculated by the LCU and input into the registers $R_1$. The calculation of this new 8-bit word for aging correction may be based on empirical determinations from aging studies made using similar printheads or based upon a calibration of this printhead using an optical sensor that senses the output from each or selected LED's or by sensing patches recorded on the photoconductor.

As noted above, a third factor for adjustment to maintain LED uniformity of light output from chip to chip is a temperature compensated current source 172. This current source includes a temperature sensor and circuitry which will assist in boosting current to the LED's in response to increases in temperature. Various circuits for accomplishing this are well known for example, see Gray and Meyer, Analysis and Design of Analog Integrated Circuits, 2nd edition, pages 733–735 and FIG. 12.28, the contents of which are incorporated by this reference. In this text description is provided of so-called $V_T$ (thermal voltage)—referenced current sources. By providing in such a circuit a resistor with an appropriate temperature coefficient, an output current, $I_o$, is provided that increases with an increase in temperature of the driver chip.

The operation of the circuit of FIGS. 4A, B and C will now be described. During use of the printhead the temperature of the driver chips will heat up differently in accordance with respective current carrying demands and abilities to dissipate heat caused by such demands through the heat conducting structure to which the chips are mounted. The temperature adjusted current $I_o$ is conducted to ground via NMOSFET transistor $Q_{33}$ and some or all of the transistors $Q_{32}, Q_{31}, \ldots$ and $Q_{25}$ depending upon the digital 8-bit signal and its 8-bit complement stored in register $R_2$. In accordance with which transistors in this group of transistors are enabled to conduct and recalling that these transistors are scaled or weighted differently in conducting capabilities the voltage level at the source terminal of $Q_{33}$ is determined. Note that switching transistors are associated with each of these digitally controlled transistors. For example, transistor $Q_{25}$ is controlled by switching transistors $Q_{250}$ and $Q_{251}$ in response to a signal causing $Q_{250}$ to conduct and $Q_{251}$ to turn off. The others are controlled similarly. This voltage level, $V_{TC}$, is also applied to the gate of transistor $Q_{13}$ and thereby controls the current conducted by transistor $Q_{13}$. As noted above, transistor $Q_{13}$ is the non-digitally controlled transistor associated with the digitally controlled transistor group $Q_5, \ldots, Q_{11}, Q_{12}$. In accordance with the digital word stored in register $R_1$ selected ones of these transistors are caused to conduct thereby affecting the bias current level I (CHIP BIAS) through PMOSFET transistor $Q_{425}$. Recall that the transistors in the group of transistors $Q_5 \ldots Q_{12}$ also have scaled or weighted current-conducting capabilities. The current through PMOSFET transistor $Q_{425}$ is the same as the current conducted through transistor $Q_{424}$, which current is replicated or scaled by current mirrors of PMOSFET slave transistors $Q_{429}, Q_{429}, \ldots$ etc., i.e., the current controlling transistors to $LED_1$, $LED_3$- - -$LED_{127}$, respectively, as well as the extra temperature sensing circuit using channel 65. Transistor $Q_{429}$ is caused to conduct when its respective logic transistors $Q_{426}, Q_{427}$ are appropriately signaled by data signals indicating a pixel to be printed. Thus, when a logic low signal is applied to line 45[1] (AN) transistor $Q_{427}$ turns on and biases the gate of transistor $Q_{429}$ to the level $V_{G2}$. The current through transistor $Q_{429}$ will mirror or be scaled to that of transistor $Q_{424}$ for the time period for exposing a pixel as controlled by the duration of the logic low signal on line $45^1$ (AN). As is noted in FIG. 4C, the current through $Q_{429}$ is fed to $LED_1$, for the recording of a pixel. Identical current levels will be developed in the other channels directly providing current to respective other LED's. Thus, all LED's driven by this driver chip receive the same current for periods determined by their respective enablement signals and the currents thereto are appropriately adjusted to maintain constant the intensity of the LED's.

ADVANTAGES

An improved circuit for a current driver chip used in an LED printhead has been described. The circuit retains the desirable feature of two-way addressability described in the prior art. That is, provision is made for digitally addressing each chip to correct for differences in light output by LED's driven by one chip versus those driven by another chip on the same printhead. These differences can arise due to processing condition differences arising during manufacture of the driver chips and for their respective driven LED's, as well as nonuniformities arising from temperature differences. A second provision for digital addressability is retained to provide for global changes due to aging. By providing both addressable portions on each driver chip problems associated with noise are minimized. In addition, providing a non-digitally controlled transistor on each addressable portion simplifies calibration and allows for more accuracy in control of uniformity. In the prior art, current regulation was provided using digitally addressable current mirrors, however, these were addressable such that current to the LED's could be varied from zero, to small amounts, and up to large amounts of current. By providing non-digitally controlled and continuously on transistors $Q_{13}$ (FIG. 4B) and $Q_{33}$ (FIG. 4A) both having substantial current-carrying capabilities, a minimum current will be produced in transistors $Q_{429}$, $Q_{429'}$, etc., the transistors carrying current to the LED's, even where the digital words stored in registers R1 and R2 cause no current to be carried in any of the digitally regulated transistors of FIGS. 4A and 4B. Thus, these transistors ($Q_{13}$ and $Q_{33}$) effectively cooperate to provide a minimum offset current and the digitally controlled transistors can be addressed to provide control over the range of possible currents between the minimum offset current and the maximum current when respective LED's are activated to turn on. Heretofore, control had to be calibrated between zero and maximum, requiring either more digitally addressed transistors to control this range or providing reduced ability to control to the desired degree.

While the preferred embodiment has been described in terms of MOSFET transistors that have their respective gates controlled, other devices providing an equivalent function such as bipolar or other gate controlled devices are also contemplated. Where bipolar transistors are used, emitter-collector-geometry or doping levels to respective transistors may be modified to provide the current scaling characteristics described herein.

The invention has been described in detail with particular reference to preferred embodiments thereof. However, it will be understood that variations and modifications may be effected within the spirit and scope of the invention.

What is claimed is:

1. A non-impact printer apparatus used for recording, comprising:

a plurality of groups of energizable recording elements;

a plurality of integrated circuit driver chips, each driver chip driving a respective group within said groups of recording elements; each driver chip including:

a) first digitally addressable current-conducting means for selectively establishing a first bias voltage in response to a first multibit digital signal;

b) second digitally addressable current-conducting means, responsive to the first bias voltage and to a second multibit digital signal, for generating a bias current and, in response to said bias current, for establishing a second bias voltage;

c) means for selectively causing current to flow through and energize recording elements being a part of a respective group of said recording elements driven by said driver chip and being selected for energization;

d) current mirror driver means for regulating levels of currents through said recording elements selected for energization, the levels of currents being related to said second bias voltage; and e) a temperature compensated current source means for providing, in response to a temperature of said driver chip, a temperature adjusted current to said first digitally addressable current-conducting means and for adjusting said first bias voltage to change the levels of currents through said recording elements selected for energization.

2. The apparatus of claim 1 and wherein each driver chip further includes a non-digitally addressable continuously operating current-conducting means cooperating with said first digitally addressable current-conducting means to establish an offset bias voltage level for said first bias voltage.

3. The apparatus of claims 1 or 2 and wherein each driver chip further includes a non-digitally addressable continuously operating current-conducting means cooperating with said second digitally addressable current-conducting means to establish an offset bias current level for said bias current.

4. The apparatus of claim 3 and wherein the recording elements are light-emitting diodes.

5. A driver chip for use on a non-impact printer apparatus for driving energizable recording elements comprising:

a) first digitally addressable current-conducting means for selectively establishing a first bias voltage in response to a first multibit digital signal;

b) a second digitally addressable current-conducting means, responsive to the first bias voltage and to a second multibit digital signal, for generating a bias current and, in response to said bias current, for establishing a second bias voltage;

c) means for selectively causing current to flow through the recording elements;

d) current mirror driver means for regulating levels of currents through the recording elements, the levels of currents being related to said second bias voltage; and e) a temperature compensated current source means for providing, in response to a temperature of said driver chip, a temperature adjusted current to said first digitally addressable current-conducting means for adjusting said first bias voltage to change the levels of currents through the recording elements.

6. The driver chip of claim 5 and further including a non-digitally addressable continuously operating current conducting means cooperating with said first digitally addressable current-conducting means to establish an offset bias voltage level for said first bias voltage.

7. The driver chip of claim 5 or 6 and further including a non-digitally addressable continuously operating current conducting means cooperating with said second digitally addressable current conducting means to establish an offset bias current level for said bias current.

* * * * *